US008628295B2

(12) United States Patent
Schmidt et al.

(10) Patent No.: US 8,628,295 B2
(45) Date of Patent: Jan. 14, 2014

(54) REGULATABLE COOLANT PUMP AND METHOD FOR ITS REGULATION

(75) Inventors: Eugen Schmidt, Merbelsrod/Thueringen (DE); Andreas Schmidt, legal representative, Schwarzbach (DE); Franz Pawellek, Lautertal (DE)

(73) Assignee: Geraete- und Pumpenbau GmbH Dr. Eugen Schmidt, Merbelsrod/Thüringen (DE)

( * ) Notice: Subject to any disclaimer, the term of this patent is extended or adjusted under 35 U.S.C. 154(b) by 707 days.

(21) Appl. No.: 12/736,696

(22) PCT Filed: May 7, 2009

(86) PCT No.: PCT/DE2009/000640

§ 371 (c)(1),
(2), (4) Date: Nov. 1, 2010

(87) PCT Pub. No.: WO2009/138058

PCT Pub. Date: Nov. 19, 2009

(65) Prior Publication Data

US 2011/0188987 A1 Aug. 4, 2011

(30) Foreign Application Priority Data

May 10, 2008 (DE) ..... 10 2008 022 354

(51) Int. Cl.
*F04D 29/00* (2006.01)

(52) U.S. Cl.
USPC ..... 415/126; 415/148

(58) Field of Classification Search
USPC ..... 415/126, 206, 148
See application file for complete search history.

(56) References Cited

U.S. PATENT DOCUMENTS

| | | | | |
|---|---|---|---|---|
| 3,784,318 | A | 1/1974 | Davis | |
| 3,811,797 | A | 5/1974 | Lewis | |
| 4,895,301 | A * | 1/1990 | Kennedy | 236/34.5 |
| 5,169,286 | A * | 12/1992 | Yamada | 415/48 |
| 6,669,439 | B2 * | 12/2003 | Kardasz et al. | 415/131 |

(Continued)

FOREIGN PATENT DOCUMENTS

| | | |
|---|---|---|
| CH | 133 892 | 6/1929 |
| DE | 2 237 246 | 2/1973 |

(Continued)

OTHER PUBLICATIONS

International Search Report.

(Continued)

*Primary Examiner* — Ninh H Nguyen
(74) *Attorney, Agent, or Firm* — Collard & Roe, P.C.

(57) ABSTRACT

A regulatable coolant pump and a method for regulation of this regulatable coolant pump for internal combustion engines, which is driven by way of a pulley actives a valve slide using an electromagnetically activated piston pump equipped with a return spring in the form of a pressure spring. The pump implements a "pump feed" using many small "partial lifts." A "leakage volume stream" that flows opposite to the "pumped volume stream" is superimposed on the "pumped volume stream" via the arrangement of circular apertures both in the inlet valve membrane of the working piston and in the outlet valve membrane so that the valve slide can be moved in defined manner and in a very robust and reliable manner, with low drive power via the defined superimposition of these two volume streams.

7 Claims, 1 Drawing Sheet

(56) References Cited

U.S. PATENT DOCUMENTS

| | | | | |
|---|---|---|---|---|
| 2002/0012583 | A1* | 1/2002 | Hesse | 415/47 |
| 2008/0003120 | A1 | 1/2008 | Meza | |
| 2008/0317609 | A1 | 12/2008 | Schmidt et al. | |

FOREIGN PATENT DOCUMENTS

| | | |
|---|---|---|
| DE | 197 09 484 | 9/1998 |
| DE | 10 2005 004 315 | 8/2006 |
| DE | 10 2005 062 200 | 2/2007 |
| DE | 10 2006 034 960 | 1/2008 |
| DE | 10 2007 019 263 | 6/2008 |
| EP | 1 657 446 | 5/2006 |
| FR | 587 131 | 4/1925 |

OTHER PUBLICATIONS

International Search Report of PCT/DE2009/000751.

* cited by examiner

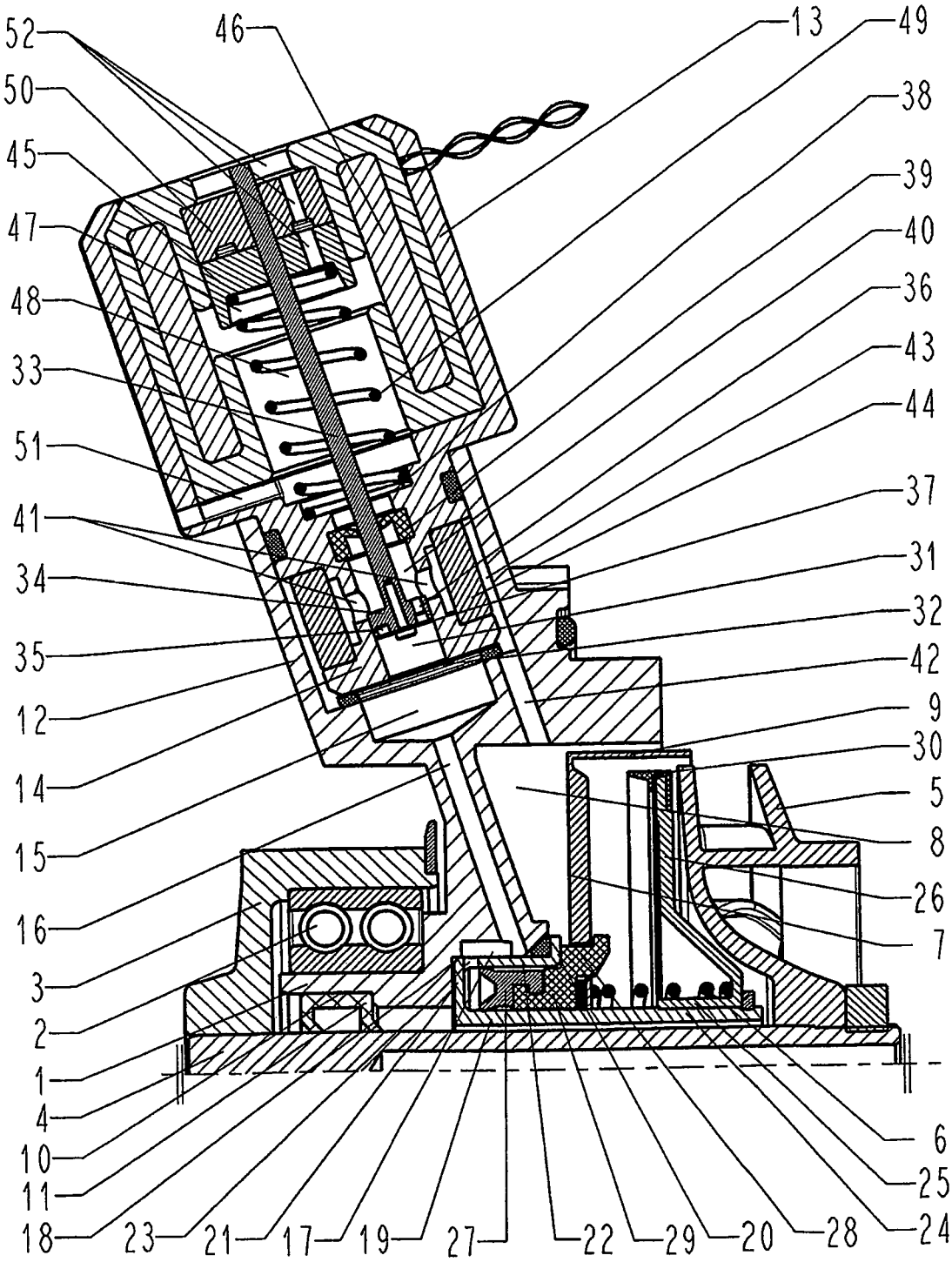
52
46
13
49
50
38
45
39
47
40
48
36
33
43
44
51
37
41
31
34
32
35
42
12
9
30
14
5
15
8
26
16
7
3
2
1
4
6
10
25
11
18
23
21
17
19
27
22
29
20
28
24

REGULATABLE COOLANT PUMP AND METHOD FOR ITS REGULATION

CROSS REFERENCE TO RELATED APPLICATIONS

This application is the National Stage of PCT/DE2009/000640 filed on May 7, 2009, which claims priority under 35 U.S.C. §119 of German Application No. 10 2008 022 354.9 filed on May 10, 2008, the disclosure of which is incorporated by reference. The international application under PCT article 21(2) was not published in English.

The invention relates to a regulatable coolant pump and to a method for regulation of this regulatable coolant pump for internal combustion engines, which is driven by way of a pulley.

In the course of the constant optimization of internal combustion engines with regard to emissions and fuel consumption, it is important to bring the engine to operating temperature as quickly as possible after a cold start.

In this way, not only are friction losses minimized (the viscosity of the motor oil, and thus the friction at all oil-lubricated parts, drops with an increasing oil temperature), but at the same time, the emission values are reduced (since the catalytic converters only become effective after the so-called "start-up temperature," the time period until this temperature is reached significantly influences the exhaust gas emissions), and also, the fuel consumption is clearly reduced.

Series of experiments in engine development have shown that a very effective measure for warming the engine is "standing water" or "zero leakage" during the cold-start phase.

In this connection, coolant should not flow through the cylinder head in any event, during the cold-start phase, in order to bring the exhaust gas temperature to the desired level as quickly as possible.

In this connection, leakage flows of less than 0.5 l/h ("zero leakage") are desired by vehicle manufacturers.

Studies concerning fuel consumption of internal combustion engines in motor vehicles have furthermore shown that about 3% to 5% fuel can be saved by means of consistent thermal management (in other words those measures that lead to optimal operation of an internal combustion engine, in terms of energy and thermomechanics).

In the state of the art, regulatable coolant pumps that are driven by the crankshaft of the internal combustion engine, by way of pulleys, are therefore also previously described, in which the impeller is driven by the pump shaft, in switchable manner (for example by way of a friction pairing).

Using such coolant pumps, simple two-point regulation can be implemented, by means of which the cooling power of the coolant pumps can be varied.

In order to allow engine warm-up during a shorter time, at first, the drive of the coolant pump is uncoupled during cold start of the engine, by means of these designs.

Once the engine has reached its operating temperature, the friction clutch, in each instance (with the functionally related wear problems inherent to this clutch design) is activated, i.e. the drive of the coolant pump is turned on.

As a result, large amounts of the coolant, which is still cold, are immediately pumped into the engine, which has warmed up to operating temperature, so that the engine necessarily and immediately cools off greatly again.

As a result, however, the desired advantages of rapid warm-up of the engine are already compensated again, in part.

Furthermore, because of the required mass acceleration when the pump is turned on again, particularly in the case of larger coolant pumps, very high torques must be overcome, and these necessarily result in great stress on the components.

Therefore two solutions that have proven themselves in the meantime were presented by the applicant, in DE 10 2005 004 315 B4 and in DE 10 2005 062 200 B3, which allow active control of the coolant feed amount, in order to guarantee optimal warm-up of the engine by means of "zero leakage," on the one hand, and, on the other hand, to influence the engine temperature after the engine has warmed up (i.e. in "continuous operation"), in such a manner that both the pollutant emission and the friction losses, and furthermore, at the same time, also the fuel consumption can be clearly reduced in the entire working range of the engine.

In these solutions, a valve slide configured in ring shape and mounted to be displaceable in the direction of the shaft axis of the pump shaft, in each instance, having an outer cylinder that variably covers the outflow region of the impeller, is disposed in the pump housing, which slide either acts on a magnetic armature rigidly connected with the valve slide, counter to the spring force of return springs, as proposed in the solution according to DE 10 2005 004 315 B4, electromagnetically, i.e. using a magnetic coil disposed in the pump housing, or, as proposed in DE 10 2005 062 200 B3, can be displaced in linear manner, by means of a pneumatically or hydraulically activated actuator (which acts hydraulically on piston rods rigidly disposed on the valve slide and guided in the pump housing). This arrangement of a guided, linearly displaceable valve slide that variably covers the outflow region of the impeller is a very compact, simple, and robust solution, which guarantees great operational security and great reliability.

The disadvantage of these solutions, however, (in connection with the often greatly limited installation space for the coolant pumps in the engine compartment of the motor vehicles) results from the absolutely necessary, relatively large "construction space" required either for the magnetic coil or for the hydraulic or pneumatic actuators and their connection lines.

Furthermore, in DE 2006 034 960 B4, a coolant pump having an electromagnetic valve slide (analogous to DE 10 2005 004 315 B4), which can be adjusted by means of a servomotor, is presented. A significant disadvantage of this design consists in that with this solution, presented in DE 2006 034 960 B4, it is not possible to achieve a "zero leakage" or "zero feed" with this solution, since the small gap seals that are proposed, on the one hand, nevertheless allow leakage, and on the other hand, the seal by way of "moving" O-rings described in connection with FIG. 4, is not reliable, since the great relative speed between the rotating O-ring and the fixed housing inevitably leads to destruction of the O-ring in operational use.

Also, both aforementioned designs of DE 10 2006 034 960 B4, as has already been explained, again require a relatively large "construction space," on the one hand, in the electromagnetic variant, for the magnetic coil, but also, on the other hand, in the "transmission technology" design, for the servomotor.

Since the electromagnetic variant includes the pump housing in the magnetic circuit, the design must necessary be adapted for every design and size, i.e. must be revised for every engine application and adapted, in terms of design.

Another disadvantage of the electromagnetic direct drive for the valve slide proposed in DE 10 2006 034 960 B4 consists in that this slide can apply sufficient force/lift for reliable activation of the valve slide, because of construction space restrictions in connection with or as a consequence of the large initial air gap, only in limited manner, i.e. with restricted reliability.

Furthermore, production and installation of the designs presented in DE 10 2005 004 315 B4, DE 10 2005 062 200 B3, and also in DE 10 2006 034 960 B4, are very cost-intensive and cannot be standardized, because, as has already been explained, most of the functional modules of the aforementioned solutions must be produced separately for every pump size, according to different design drawings.

In this connection, the solution presented in DE 10 2005 062 200 B3 furthermore requires air-free filling in the plant.

Another design of a mechanically driven coolant pump was presented in DE 197 09 484 A1. In this solution, a bypass was produced by means of increasing the size of the gap between open impeller and housing. This gap can be varied by means of an electromagnet in the solution proposed in DE 197 09 484 A1, whereby in related manner, the control of the electromagnet takes place by means of a pulse-width-modulated voltage.

This solution, as well, again demonstrates significant disadvantages, which consist, among other things, in that with the solution proposed in DE 197 09 484 A1, it is by no means possible to achieve a "zero leakage," i.e. a zero feed amount, and that furthermore, even when the bypass is open, the power consumption of the pump is not significantly decreased (when the bypass is open, it is true that the counter-pressure of the pump drops—but the volume stream increases), i.e. with this solution, only a poor degree of effectiveness can be implemented.

The invention is therefore based on the task of developing a regulatable coolant pump and a method for regulation of this regulatable coolant pump (with slide valve) for internal combustion engines, which is driven by way of a pulley, which pump eliminates the aforementioned disadvantages of the state of the art, and, in this connection, on the one hand guarantees optimal warm-up of the engine, by means of "zero leakage," and on the other hand is able to influence the engine temperature, in continuous operation, after the engine has warmed up, so precisely that not only the pollutant emission but also the friction losses and the fuel consumption can be clearly reduced, in the entire working range of the engine, and which furthermore allows reliable activation of the valve slide even in the case of very severely limited installation space for the coolant pump in the engine compartment, with very low drive power, and guarantees continued functioning of the coolant pump (fail-safe) even if the regulation fails, and is furthermore characterized by a design that is very simple in terms of production and assembly technology, cost-advantageous, "standardizable" for different pump sizes, optimally utilizes the construction space available in the engine compartment, in this connection does not require air-free filling in the plant, and furthermore always guarantees a high level of operational security and reliability at a high degree of effectiveness, and furthermore can be included in the engine management in simple and cost-advantageous manner.

According to the invention, this task is accomplished by means of a device and a method for regulation of a coolant pump for internal combustion engines that is driven by way of a pulley, according to the characteristics of the independent claims of the invention.

Advantageous embodiments, details, and characteristics of the invention are evident from the dependent claims as well as from the following description of the solution according to the invention, in connection with a drawing of the solution according to the invention.

In FIG. 1, the regulatable coolant pump according to the invention is shown in a side view, in section, with the position of the valve slide in its rear end position (i.e. in the working position "OPEN").

In this design, a pump shaft 4 driven by a pulley 3 is disposed on a pump housing 1, in a pump bearing 2, with an impeller 5 disposed on the free, flow-side end of this pump shaft 4, so as to rotate with it.

Furthermore, a pressure-activated valve slide that is spring-loaded by a return spring 6, and has a back wall 7 and an outer cylinder 9 that variably covers the outflow region of the impeller 5, is disposed in the pump interior 8.

A shaft sealing ring 11 is disposed in the pump housing 1, between the impeller 5 and the pump bearing 2, in a seal accommodation 10.

According to the invention, a working housing 12 is disposed on the pump housing 1, and, in this housing, the housing of an electromagnetic actuator 13 is disposed, whereby a working sleeve 14 is disposed in the working housing 12. Adjacent to this sleeve, a pressure chamber 15 is disposed on the pump shaft side, in the working housing 12, which chamber empties, by way of a pressure channel 16, into a ring channel 17 that is worked into a sleeve accommodation 18 disposed in the pump housing 1 to lie opposite the seal accommodation 10, on the impeller side, with rotation symmetry relative to the axis of rotation of the pump shaft 4.

It is advantageous, in this connection, if the housing of the actuator 13 and the working sleeve 14 are produced in one piece.

It is also essential to the invention that a ring piston working sleeve 19, having a sealing crosspiece 20 and a bottom 21, is disposed in the sleeve accommodation 18, in which sleeve the pump shaft 4 rotates freely.

In the outer wall 22 of the ring piston working sleeve 19, flow-through openings 23 to the ring channel 17 are disposed close to the bottom 21.

On the impeller-side end of the ring piston working sleeve 19, a position-securing sleeve 25, having a wall disk 26 disposed rigidly on it, is attached, with force fit, on the inner wall 24 of the ring piston working sleeve 19, which clearly projects beyond the outer wall 22 of the ring piston working sleeve 19.

It is also characteristic that a profile seal ring 27 is disposed spaced apart from the bottom 21 of the ring piston working sleeve 19 approximately by the diameter of the flow-through openings 23 and displaceable in the ring piston working sleeve 19. This seal ring is connected, on the impeller side, with a ring piston 29 provided with a crosspiece contact 28, with shape fit. The back wall 7 of the valve slide is disposed on the ring piston 29, in its impeller-side end region, with shape fit.

It is advantageous in this connection if the profile seal ring 27 is linked into a related entrainment groove disposed on the ring piston 29.

However, it is also advantageous if a seal ring is disposed between the sealing crosspiece 20 and the pump housing 1.

According to the invention, the return spring 6 is disposed between the wall disk 26 and the back wall 7 of the valve slide, which lies against the ring piston 29.

It is furthermore characteristic that a bypass seal 30 having an elastomer sealing lip is disposed at the outer edge of the wall disk 26, which seal prevents a pressure buildup between the wall disk 26 and the back wall 7 of the valve slide when the valve slide is "closed," with the bypass leakages that result from this.

The arrangement of the bypass seal 30 with the elastomer sealing lip, according to the invention, brings about a tolerance equalization, at the same time.

The primary seal is guaranteed between the face surface of the outer cylinder 9 and the related counter-surface in the spiral housing.

In the interaction of the two aforementioned sealing locations with the valve slide, an essential demand on the solution according to the invention, the function of "zero leakage" (zero feed) with minimal power consumption can be optimally implemented, in order to shut the coolant volume stream down completely during the warm-up phase of the engine, when needed, in functionally secure and reliable manner.

This arrangement of a cylinder-shaped, spring-loaded ring piston 29 guided in a ring piston working sleeve 19, according to the invention, now allows reliable, path-precise displacement of the valve slide 9, by way of a defined application of pressure to the profile seal 27, and, at the same time, represents a construction-space-optimized, compact solution, which is simple in terms of production and assembly technology, as well as cost-advantageous and furthermore very robust, which solution always guarantees great operational security and reliability.

It is also essential to the invention that a working space 31 adjacent to the pressure chamber 15 is disposed in the working sleeve 14, whereby an outlet valve membrane 32 provided with a circular aperture is disposed between the working space 31 and the pressure chamber 15.

According to the invention, a working piston 34 disposed on a piston rod 33 is disposed in the working space 31, so as to be linearly displaceable. On this working piston 34, a ring groove 35 having passage bores 36 is disposed, on the working space side. Furthermore, an inlet valve membrane 37 provided with a circular aperture is attached to the working piston 34 adjacent to the ring groove 35, disposed on the working piston 34, on the working space side.

It is also characteristic that a pressure spring contact 38 is disposed on the working sleeve 14, opposite the working space 31.

According to the invention, a rod seal 39 that encloses the piston rod 33 is disposed between the working space 31 and the pressure spring contact 38.

It is essential to the invention that an inflow space 40 is disposed in the working sleeve 14 between the working space 31 and the rod seal 39, in the wall of which space inflow openings 41 are disposed, which lead into a ring space 43 disposed between the working housing 12 and the working sleeve 14, which space is connected with the pump interior 8 by way of one or more inlet bores 42.

It is also characteristic that a filter element 44 is disposed between the ring space 43 and the inflow openings 41.

According to the invention, a magnetic armature 45 is disposed on the end of the piston rod 33 that lies opposite the working piston 34, which armature is guided in the actuator 13 in the magnetic field of a magnetic coil 46 disposed in a coil accommodation in the housing of the actuator 13, in linearly displaceable manner.

It is also characteristic that a pressure spring 49 is disposed between the pressure spring contact 38 disposed on the working sleeve 14 and a spring accommodation 47 disposed on the magnetic armature 45, in a spring chamber 48.

It is advantageous if an armature stop 50, preferably having (a) damping element(s), is disposed in the actuator 13, adjacent to the magnetic armature 45.

According to the invention, an inflow opening 51 that leads into the region of the spring chamber 48 is disposed in the housing of the actuator 13, and outflow openings 52 that lie adjacent to one another/make a transition into one another, in each instance, are disposed in the magnetic armature 45, in the armature stop 50, and in the housing of the actuator 13.

Since the rod seal 39 separates the region of the activation device that carries coolant from a ("dry") region filled with air, the inflow opening 51 and the outflow openings 52 allow a free gas exchange with the surroundings, so that in this way, a low-friction translational movement of the magnetic armature 45 in the region of the magnetic coil 46 is guaranteed.

In this connection, a relatively slight diameter of the piston rod once again reduces the friction losses at the piston rod in the region of the rod seal 39.

The method according to the invention, for influencing the transport amount of the regulatable coolant pump that is described, and shown in FIG. 1, is now characterized in that the force that acts on the magnetic armature 45 in the magnetic field 46 is varied by means of variation of the current strength and/or the time duration of the current pulses applied to the magnetic coil, so that, in combination with the effect of the pressure spring 49 on the magnetic armature 45, the frequency and/or the lift (the amplitude) of the vibrations of the working piston is/are varied in defined manner, so that the working piston 34 is repeatedly (periodically) displaced by means of the magnetic armature 45 disposed at the opposite end of the piston rod 33, in the magnetic field of the magnetic coil 46, and is put into defined translational vibrations.

This magnetic activation, in combination with the arrangement according to the invention, brings about a "pump feed" that is stepped down into many small "partial lifts"; this feed then has the result of a displacement of the valve slide with its outer cylinder 9 and the modules disposed on it, as a result of the special arrangement according to the invention.

The functional principle according to the invention thus guarantees, for the first time, that activation forces of any desired size can be achieved, at minimal construction space, very low weight, an optimal air gap, and an optimized force/lift ratio, by means of the special arrangement according to the invention, along with working strokes at the valve slide with its profile seal 27, its ring piston 29, its back wall 7, its outer cylinder 9, and all the modules disposed on these components, according to the invention.

In the present exemplary embodiment, the working piston 34 now vibrates at a frequency of 20 Hz, for example, whereby the vibration amplitude, in each instance (and thus the stroke of the working piston 34) can be varied in defined manner, with the arrangement shown in FIG. 1, by means of a current that is applied to the magnetic coil 46 in pulse-like manner.

Regulation of the transport amount of the coolant pump according to the invention is achieved, according to the invention, in that on the one hand, a ring groove 35 having passage bores 36 is disposed on the working piston 34 on the working space side, and that furthermore, an inlet valve membrane 37 provided with a circular aperture is disposed on the working piston 34, on the working space side, as shown in FIG. 1.

At the same time, on the other hand, an outlet valve membrane 32 provided with a circular aperture is disposed between the working space 31 and the pressure chamber 15. If the working piston 34 is now put into vibration (as described above), then coolant is drawn into the inflow space 40 from the ring space 43 connected with the pump interior 8 by way of the inlet bore 42, through the filter element 44, by way of the inflow openings 41, and, at the same time, it is pressed through the passage bores 36 of the working piston 34 into the ring groove 35 disposed on the working piston, and from there into the working space 31, by way of the inlet valve membrane 37 provided with a circular aperture, and then from there it is introduced into the pressure chamber 15, by way of the outlet valve membrane 32 provided with a circular aperture.

This coolant, introduced into the pressure chamber 15, is passed into the ring channel 17 by way of the pressure channel 16, and from there into the ring piston working sleeve 19, by way of the flow-through openings 23, and there brings about a defined application of pressure to the profile seal 27 and thus an application of pressure to the spring-loaded ring piston 29, which is therefore translationally moved and brings about a displacement of the valve slide 9, due to the arrangement according to the invention.

As a result of the arrangement of circular apertures, according to the invention, both in the inlet valve membrane 37 of the working piston 34 and in the outlet valve membrane 32 (i.e. between the working space 31 and the pressure chamber 15), not only does the "pumped volume stream" just described occur, which is pumped by the working piston 34, according to the invention, but, at the same time, a slighter "leakage volume stream" that always flows in the opposite direction occurs between the ring piston working sleeve 19, by way of the working space 31, into the pump interior.

The superimposed "interplay" of these two volume streams, according to the invention, which can be varied by way of the amplitude or by way of the amplitude and/or the frequency of the vibrations of the working piston 34, by means of the solution according to the invention, brings about a reliable, path-precise displacement of the spring-loaded ring piston 29 that is disposed in the ring piston working sleeve 19, according to the invention, as a result of the working pressure that is built up in the pressure chamber 15, in each instance, and thus reliable, path-precise displacement of the valve slide 9 disposed on the ring piston 29, which slide in turn then brings about a precise variation of the transport amount of the regulatable coolant pump according to the invention.

Because of the arrangement according to the invention, in this connection it is possible to produce activation forces and lifts of any desired size at the ring piston 29 of the valve slide.

As a result of the arrangement according to the invention, it is furthermore possible to make available a piston force that is sufficient for activation of the valve slide, even at very restricted installation space, with minimal use of energy.

This is also connected with the fact that it can take several seconds in the coolant circuit until the valve slide has moved to the position to be taken.

Because of this, the solution according to the invention, which can be easily standardized and produced in cost-advantageous manner, guarantees a high degree of pump and engine effectiveness, with minimal use of energy (which lies below 5 W).

The "neutral" method of construction according to the invention makes it possible that the actuator 13 according to the invention can be used in different water pumps, as a standardized component.

Thus, a quantity effect sets in, which decisively improves the economic efficiency and variability in use for different motor vehicles (engine series) for the most varied installation spaces.

The activation unit according to the invention, which represents a construction-space-optimized, compact solution, which is simple in terms of production and assembly technology, and overall very cost-advantageous and robust, thus allows reliable activation of the valve slide even in the case of very greatly restricted installation space (for the activation device of the coolant pump).

In the event of a failure of the regulation, continued functioning of the coolant pump ("fail-safe") is also guaranteed by means of the solution according to the invention.

In this case, the pressure spring 6, in combination with the "leakage flow," displaces the valve slide into the "OPEN" working position.

During spring-loaded "retraction" of the ring piston 29 into the "fail-safe position," the coolant is pressed out of the ring piston working sleeve 19 by way of the circular apertures of the outlet valve membrane 32 (i.e. between the working space 31 and the pressure chamber 15) and the circular apertures of the inlet valve membrane 37 of the working piston, back into the pump interior, whereby the valve slide moves into the "OPEN" working position, the "fail-safe position."

Furthermore, in the solution according to the invention, air-free filling of the activation device of the valve slide in the plant can be eliminated, since the working medium required for displacement of the valve slide, the coolant fluid, can be drawn in directly from the pump interior.

Another advantage of the solution according to the invention furthermore consists in that the filter element 44 does not need to be replaced during the entire lifetime, since only very slight volume streams are exchanged by way of the filter element 44 (and these streams furthermore are only sent "forth" and then "back" again, at all times).

REFERENCE SYMBOL LIST

1 pump housing
2 pump bearing
3 pulley
4 pump shaft
5 impeller
6 return spring
7 back wall
8 pump interior
9 outer cylinder
10 seal accommodation
11 shaft sealing ring
12 working housing
13 actuator
14 working sleeve
15 pressure chamber
16 pressure channel
17 ring channel
18 sleeve accommodation
19 ring piston working sleeve
20 sealing crosspiece
21 bottom
22 outer wall
23 flow-through opening
24 inner wall
25 position-securing sleeve
26 wall disk
27 profile seal
28 crosspiece contact
29 ring piston
30 bypass seal
31 working space
32 outlet valve membrane
33 piston rod
34 working piston
35 ring groove
36 passage bore
37 inlet valve membrane
38 pressure spring contact
39 rod seal

40 inflow space
41 inflow openings
42 inlet bores
43 ring space
44 filter element
45 magnetic armature
46 magnetic coil
47 spring accommodation
48 spring chamber
49 pressure spring
50 armature stop
51 inflow opening
52 outflow opening

The invention claimed is:

1. Regulatable coolant pump having a pump housing (1), a pump shaft (4) mounted in/on the pump housing (1) in a pump bearing (2) and driven by a pulley (3), an impeller (5) disposed on a free, flow-side end of this pump shaft (4), so as to rotate with it, a pressure-activated valve slide, spring-loaded by means of a return spring (6), having a back wall (7) and an outer cylinder (9) that variably covers the outflow region of the impeller (5), disposed in the pump interior (8), as well as a shaft sealing ring (11) disposed in a seal accommodation (10), between the impeller (5) and the pump bearing (2), in the pump housing (1), wherein a working housing (12) is disposed on the pump housing (1), and on the former, the housing of an electromagnetic actuator (13) is disposed, whereby a working sleeve (14) is disposed in the working housing (12), to which sleeve a pressure chamber (15) is adjacent, in the working housing (12), on the pump shaft side, which chamber opens, by way of a pressure channel (16), into a ring channel (17), which is worked into a sleeve accommodation (18) disposed to lie opposite the seal accommodation (10), on the impeller side, in the pump housing (1), with rotation symmetry relative to the axis of rotation of the shaft (4), a ring piston working sleeve (19), having a sealing crosspiece (20) and a bottom (21), is disposed in the sleeve accommodation (18), within which the pump shaft (4) rotates freely, and in the outer wall (22) of which sleeve flow-through openings (23) to the ring channel (17) are disposed close to the bottom (21), whereby on the impeller-side end, a position-securing sleeve (25), having a wall disk (26) disposed rigidly on it, is attached, with shape fit and/or force fit, on the inner wall (24) of the ring piston working sleeve (19), which clearly projects beyond the outer wall (22), a profile seal ring (27) is disposed spaced apart from the bottom (21) of the ring piston working sleeve (19) approximately by the diameter of the flow-through openings (23) and displaceable in the ring piston working sleeve (19), which seal ring is connected, on the impeller side, with a ring piston (29) provided with a crosspiece contact (28), with shape fit, and the back wall (7) of the valve slide is disposed on its impeller-side end region, with shape fit and/or force fit, the return spring (6) is disposed between the wall disk (26) and the ring piston (29), or the wall disk (26) and the back wall (7) of the valve slide, which lies against the ring piston (29), a bypass seal (30) is disposed on the outer edge of the wall disk (26), a working space (31) adjacent to the pressure chamber (15) is disposed in the working sleeve (14), whereby an outlet valve (32) provided with a circular aperture is disposed between the working space (31) and the pressure chamber (15), a working piston (34) disposed on a piston rod (33) is disposed in the working space (31), in linearly displaceable manner, whereby a ring groove (35) having passage bores (36) is disposed on this working piston (34), on the working space side, and furthermore, an inlet valve membrane (37) provided with a circular aperture is attached to the working piston (34) on the working space side, a pressure spring contact (38) is disposed on the working sleeve (14), lying opposite the working space (31), a rod seal (39) that encloses the piston rod (33) is disposed between the working chamber (31) and the pressure spring contact (33), an inflow space (40) is disposed between the working space (31) and the rod seal (39), in the working sleeve (14), in the wall of which space inflow openings (41) are disposed, which open into a ring space (43) disposed between the working housing (12) and the working sleeve (14), which space is connected with the pump interior (8) by way of one or more inlet bores (42), whereby a filter element (44) is disposed between the ring space (43) and the inflow openings (41), a magnetic armature (45) is disposed on the end of the piston rod (33) that lies opposite the working piston (34), which armature is guided in the magnetic field of a magnetic coil (46) disposed in a coil accommodation in the housing of the actuator (13), in linearly displaceable manner, in the actuator (13), a pressure spring (49) is disposed in a spring chamber (48), between the pressure spring contact (38) disposed on the working sleeve (14) and a spring accommodation (47) disposed on the magnetic armature (45), an armature stop (50) is disposed in the actuator (13), adjacent to the magnetic armature (45), and one/multiple inflow opening(s) (51) that lead into the region of the spring chamber (48) is/are disposed in the housing of the actuator (13), and outflow openings (52) that are adjacent to one another are disposed in the magnetic armature (45), in the armature stop (50), and in the housing of the actuator (13).

2. Method for regulation of a coolant pump according to claim 1, wherein the transport amount of the coolant pump is regulated, in defined manner, by means of the displacement of the valve slide, by means of variation of the amplitude and/or of the frequency of the vibrations of the working piston (34).

3. Method for regulation of a coolant pump according to claim 2, wherein the force that acts on the magnetic armature (45) in the magnetic field (46) is varied by means of variation of the current strength and/or the time duration of the current pulses applied to the magnetic coil, so that, in combination with the effect of the pressure spring (49) on the magnetic armature (45), the frequency and/or the lift (the amplitude) of the vibrations of the working piston (34) is/are varied in defined manner, so that the working piston (34) is (repeatedly/periodically) displaced by means of the magnetic armature (45) disposed at the opposite end of the piston rod (33), in the magnetic field of the magnetic coil (46), and is put into defined translational vibrations.

4. Regulatable coolant pump according to claim 1, wherein the housing of the actuator (13) and the working sleeve (14) together are produced from one piece.

5. Regulatable coolant pump according to claim 1, wherein the profile seal ring (27) is linked into a related entrainment groove disposed on the ring piston (29).

6. Regulatable coolant pump according to claim 1, wherein a seal ring is disposed between the sealing crosspiece (20) and the pump housing (1).

7. Regulatable coolant pump according to claim 1, wherein one/multiple inflow opening(s) (51) that lead into the region of the spring chamber (48) is/are disposed in the housing of the actuator (13), and outflow openings (52) that are adjacent to one another are disposed in the magnetic armature (45), in the armature stop (50), and in the housing of the actuator (13).

* * * * *